US011957165B2

(12) United States Patent
Kindvall

(10) Patent No.: US 11,957,165 B2
(45) Date of Patent: Apr. 16, 2024

(54) ORAL POUCHED NICOTINE PRODUCT INCLUDING A FILLING MATERIAL COMPRISING NICOTINE-CONTAINING PARTICLES

(71) Applicant: Swedish Match North Europe AB, Stockholm (SE)

(72) Inventor: Mårten Kindvall, Gothenburg (SE)

(73) Assignee: SWEDISH MATCH NORTH EUROPE AB, Stockholm (SE)

( * ) Notice: Subject to any disclaimer, the term of this patent is extended or adjusted under 35 U.S.C. 154(b) by 366 days.

(21) Appl. No.: 17/624,794

(22) PCT Filed: Jul. 3, 2020

(86) PCT No.: PCT/EP2020/068797
§ 371 (c)(1),
(2) Date: Jan. 4, 2022

(87) PCT Pub. No.: WO2021/004928
PCT Pub. Date: Jan. 14, 2021

(65) Prior Publication Data

US 2022/0248748 A1 Aug. 11, 2022

(30) Foreign Application Priority Data

Jul. 5, 2019 (EP) ..... 19184827

(51) Int. Cl.
*A24F 23/02* (2006.01)
*A24B 13/00* (2006.01)
*A24B 15/28* (2006.01)

(52) U.S. Cl.
CPC ..... *A24F 23/02* (2013.01); *A24B 13/00* (2013.01); *A24B 15/283* (2013.01)

(58) Field of Classification Search
CPC ..... A24F 23/02; A24B 13/00; A24B 15/283
See application file for complete search history.

(56) References Cited

U.S. PATENT DOCUMENTS

2010/0170522 A1* 7/2010 Sun ..... A24B 15/16 131/274
2014/0255452 A1 9/2014 Reddick et al.
(Continued)

FOREIGN PATENT DOCUMENTS

EP 1338288 5/2006
EP 2177213 1/2013
(Continued)

OTHER PUBLICATIONS

International Search Report and Written Opinion were dated May 11, 2020 by the International Searching Authority for International Application No. PCT/EP2020/068797 filed on Jul. 3, 2020 and published as WO 2021/004928 (Applicant—Swedish Match North Europe AB) (9 pages).

*Primary Examiner* — Christopher M Rodd
*Assistant Examiner* — Jennifer A Kessie
(74) *Attorney, Agent, or Firm* — Ballard Spahr LLP

(57) ABSTRACT

The present disclosure relates an oral pouched nicotine product comprising a filling material and a saliva-permeable pouch of a packaging material enclosing the filling material, said filling material comprising: —particles having a sphericity from 0.7 to 1.0, such as from 0.8 to 1.0, and a diameter from 0.2 mm to 2.0 mm, said particles comprising: (i) a core having an outer surface, said core comprising a material selected from the group consisting of cellulose, starch, polyalcohol, sugar and any combinations thereof, (ii) a first coating comprising a saliva-soluble binder and a nicotine source, said first coating being applied on at least part of the outer surface of said core, wherein said particles are provided in an amount within the range of from 50 wt % to 100 wt %, such as from 50 wt % to 90 wt %, based on the total weight of said filling material, and—optionally a tobacco material within the range of from 0.05 wt % to 10 wt %, based on the total weight of the filling material. The present
(Continued)

disclosure also relates to a method for preparing an oral pouched nicotine product comprising the aforementioned filling material.

20 Claims, 5 Drawing Sheets

(56) References Cited

U.S. PATENT DOCUMENTS

| | | | |
|---|---|---|---|
| 2016/0073689 | A1 | 3/2016 | Sebastian et al. |
| 2018/0271139 | A1 | 9/2018 | Aspgren et al. |

FOREIGN PATENT DOCUMENTS

| | | | |
|---|---|---|---|
| EP | 3491940 | A1 | 6/2019 |
| NO | 20170683 | A | 10/2018 |
| WO | WO 2010/104464 | A1 | 9/2010 |
| WO | WO 2012/134380 | A1 | 10/2012 |
| WO | WO 2018/197454 | | 11/2018 |
| WO | WO 2019/115778 | A1 | 6/2019 |

* cited by examiner

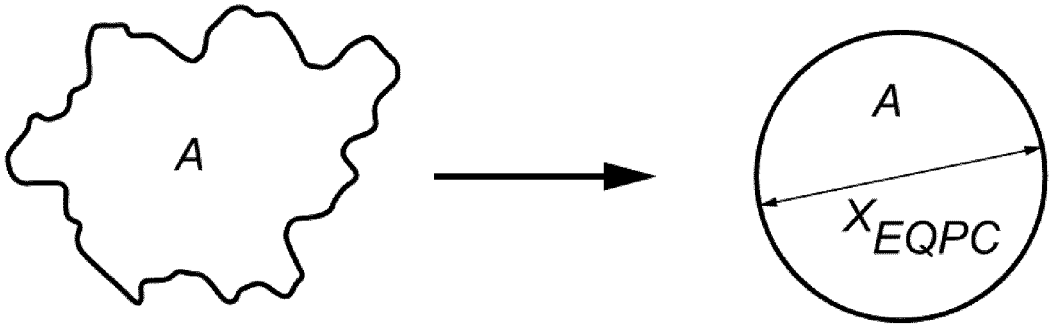
Figure 7a
Figure 7b
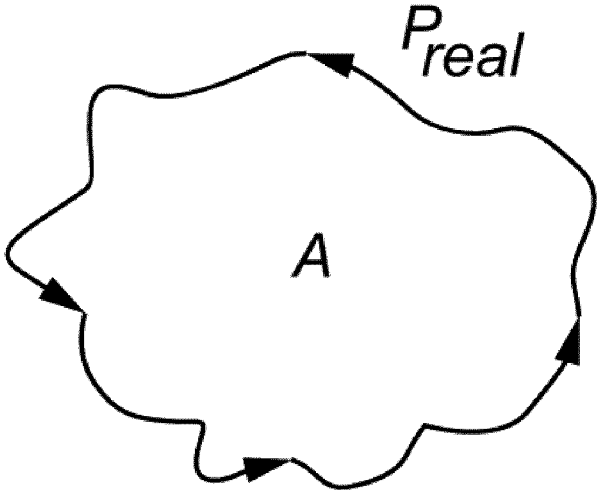
$$S = \frac{P_{EQPC}}{P_{real}} = \frac{2\sqrt{\pi \cdot A}}{P_{real}}$$
Figure 7c

ORAL POUCHED NICOTINE PRODUCT INCLUDING A FILLING MATERIAL COMPRISING NICOTINE-CONTAINING PARTICLES

CROSS-REFERENCE TO RELATED APPLICATIONS

This application is a U.S. National Phase Application of International Application No. PCT/EP2020/068797, filed Jul. 3, 2020, which claims priority to European Application No. 19184827.4, filed Jul. 5, 2019, each of which are hereby incorporated by reference in their entirety.

TECHNICAL FIELD

The present disclosure relates to an oral pouched nicotine product comprising a filling material and a saliva-permeable pouch of a packaging material enclosing the filling material, wherein the filling material comprises particles having a sphericity from 0.7 to 1.0 and a diameter from 0.2 mm to 2.0 mm. The present disclosure also relates to a method for preparing the aforementioned oral pouched nicotine product. Further, the present disclosure also relates to a method for preparing such a filling material.

BACKGROUND

Traditionally, oral smokeless tobacco products are used in the oral cavity of a consumer to provide nicotine satisfaction from the tobacco in the product. In addition to the tobacco, the oral smokeless tobacco product generally comprises water, salt, pH adjuster(s) and additional ingredients such as flavours and humectants. Commonly, these products are called snuff. The snuff may be dry or moist, and may be provided in loose form or in pouched form. Moist snuff is divided into two types, namely American snuff and Scandinavian snuff. American moist snuff is commonly produced through a fermentation process of moisturized ground or cut tobacco. Scandinavian-type moist snuff (snus) is commonly produced using a heat-treatment process (pasteurization) instead of fermentation. The heat treatment is carried out in order to degrade, destroy or denature at least a portion of the organisms within the tobacco preparation.

Oral pouched nicotine products comprising no tobacco or a small amount of tobacco are now becoming increasingly popular among consumers due to inter alia their appealing appearance, freshness and taste. Moreover, this kind of product allows a user to enjoy nicotine without being exposed to tobacco.

Oral pouched nicotine products are typically used by the consumer by placing the pouch between the upper or lower gum and the lip and retaining it there for a limited period of time. The product is configured to fit comfortably and discreetly in the user's mouth. The pouch material holds the filling material in place allowing saliva to pass into the filling material and allowing flavours and nicotine to diffuse from the filling material into the consumer's mouth.

The filling material of such oral smokeless non-tobacco snuff products or oral smokeless low tobacco snuff products comprises nicotine.

EP 2 177 213 discloses nicotine-containing granulate comprising a homogenous mixture of 1-50% nicotine and 0-99% excipient, wherein the granulate has a particle size of at least 150 μm. The excipient may be cellulose. The nicotine-containing granulate is dust-reduced or dust-free due to the presence of the excipient which imparts cohesion to the granulate particles. It is mentioned that the nicotine-containing granulate may be used for the preparation of a pharmaceutical product for oral administration.

EP 1 338 288 discloses cellulose particles for pharmaceutical use, which contain microcrystalline cellulose having an average degree of polymerization of from 60 to 350 in an amount of not less than 10%, and which have a tapped bulk density of from 0.60 to 0.95 g/ml, an aspect ratio of not less than 0.7, a shape factor of from 1.10 to 1.50, and an average particle size of from 10 to 400 μm. Preferably, the particle size is from 40 to 400 μm, more preferably from 50 to 400 μm, much more preferably from 50 to 300 μm, and particularly preferably from 50 to 200 μm. The particles may be granules containing a medicine inside or on their surface.

NO 20170683A discloses an oral pouched nicotine product comprising a moist filling material and a saliva-permeable pouch of a packaging material enclosing the moist filling material, wherein the moist filling material comprises a particulate non-tobacco material, such as microcrystalline cellulose, a flavouring agent, a nicotine source, a pH adjusting agent, and within the range of from 0.5 to 20% by weight, based on total weight of the filling material, of triglyceride.

EP 3491940 A1 discloses a method of manufacturing a filling material for a pouched smokeless snus product, the method comprising the steps of: a) coating non-tobacco plant material with nicotine; b) mixing the coated non-tobacco plant material with further ingredients and optionally tobacco material to form the filling material; and c) optionally subjecting the filling material to a pasteurization step; as well as to products of such method.

US 2014/255452 A1 discloses an oral nicotine-containing pharmaceutical pouch product wherein identifying information related to the product is provided on or within the pouch, and methods of forming such products. The product can have an outer water-permeable pouch, a nicotine-containing pharmaceutical composition situated within the outer water-permeable pouch, and product identifying information relating to the nicotine-containing pharmaceutical composition.

US 2016/073689 A1 discloses pouched product adapted for release of a water-soluble component therefrom is provided herein. The pouched product can include an outer water-permeable pouch defining a cavity containing a composition that includes a water-soluble component capable of being released through the water-permeable pouch and has a surface area, wherein the outer water-permeable pouch can include a non-woven web including a plurality of heat sealable binder fibers blended with a second plurality of dissimilar fibers.

WO 2019/115778 A1 an oral pouched nicotine product comprising a moist filling material and a saliva-permeable pouch of a packaging material enclosing the moist filling material, wherein the moist filling material comprises a particulate non-tobacco material; a non-encapsulated non-particulate flavouring agent; a nicotine source; a pH adjusting agent; a monoglyceride; and tobacco material within the range of from 0% to 10% by weight, based on the total weight of the moist filling material.

WO 2010/104464 A1 discloses an oral delivery product comprising a semi-permeable pouch designed for delivery of an active agent in the oral cavity of a subject. The pouch encloses multiple particles, and the particles are alginate matrices that comprise an active agent, e.g. nicotine. The alginate is may be sodium alginate.

WO 2012/134380 A1 a product for oral delivery of nicotine containing a core comprising a powder of at least one free nicotine salt, at least one pH adjusting agent and at least one filler, and a water insoluble pouch, wherein said pouch is permeable for saliva and therein dissolved parts of the powder, wherein said product upon contact with purified water gives a pH of at least 6.

US 2018/271139 A1 discloses an oral pouched product, such as an oral pouched smokeless tobacco product, which comprises a filling material, such as tobacco material, and a saliva-permeable pouch enclosing the filling material, the product having a rectangular shape with a maximum length and a maximum width, wherein the maximum width of the product is within the range of from 3 mm to 10 mm, the maximum length of the product is within the range of from 25 mm to 40 mm, the ratio of maximum length to maximum width is within the range of from 3 to 6, and the oral pouched product has a weight within the range of from 0.3 to 0.7 g.

While powders and granulates are useful in many applications, the small size, irregular shape and/or low fluidity of the powder or granulate particles are frequently associated with problems such as dust, difficulties in transformation into a particular shape and/or release of most of an ingredient added to the powder or granulate particles such as release of an ingredient accompanied by a substantial change of the size and/or shape of the powder or granulate particles.

There is thus a need for an oral nicotine-containing product involving little or no dust, which allows for release of most or all of its nicotine, which provides a pleasant mouth feeling and/or which substantially retains its size, shape and mouth feeling during use in the oral cavity.

SUMMARY

It is an object of the present disclosure is to alleviate at least one of the problems discussed above, and/or to provide advantages and aspects not provided by hitherto known technique.

Further, it is an object of the present disclosure to provide an oral pouched nicotine product which provides a pleasant mouth comfort, mouthfeel and/or organoleptic experience of a consumer during oral use.

Another object of the present disclosure is to provide an oral pouched nicotine product having a satisfactory release rate of nicotine in the oral cavity under normal user conditions.

Yet another object of the present disclosure is to reduce or eliminate dust formed when preparing a pouch for oral use comprising the filling material as described herein.

The present disclosure provides an oral pouched nicotine product comprising a filling material and a saliva-permeable pouch of a packaging material enclosing the filling material, said filling material comprising:

particles having a sphericity from about 0.7 to about 1.0, such as from about 0.8 to about 1.0 and a diameter from about 0.1 to about 2.0, such as from about 0.2 mm to about 2.0 mm, each of said particles comprising:

(i) a core having an outer surface, said core comprising a material selected from the group consisting of cellulose, starch, polyalcohol, sugar and any combinations thereof, (ii) a first coating comprising a saliva-soluble binder and a nicotine source, said first coating being applied on at least part of the outer surface of said core, wherein said particles are provided in an amount within the range of from 50 wt % to 100 wt %, such as from 50 wt % to 90 wt %, based on the total weight of said filling material, and optionally a tobacco material within the range of from 0.05 wt % to 10 wt %, based on the total weight of the filling material.

The present disclosure also provides a method for preparing an oral pouched nicotine product, said method comprising the steps of:

a) providing a filling material as described herein, and b) enclosing said filling material in a saliva-permeable pouch as described herein.

Definitions

The term "tobacco material" is used herein for fibrous material of tobacco leaves, parts of leaves, such as lamina and stem, or tobacco extract. The leaves and parts of leaves may be finely divided (disintegrated), such as ground, cut, shredded or threshed, and the parts of leaves may be blended in defined proportions in the tobacco material.

By "tobacco" as used herein is meant any part, e.g., leaves, stems, and stalks, of any member of the genus *Nicotiana*. The tobacco may be whole, shredded, threshed, cut, ground, cured, aged, fermented, or treated otherwise, e.g., granulated or encapsulated.

The term "nicotine source" refers to nicotine in any form, such as liquid or solid form.

As used herein the terms "pouched nicotine product for oral use" or "oral pouched nicotine product" and the like refer to a portion of nicotine-containing filling material packed in a saliva-permeable pouch material intended for oral use. Two examples of oral pouched nicotine products are oral pouched nicotine non-tobacco products and oral pouched low tobacco nicotine products.

As used herein the terms "oral pouched nicotine non-tobacco product", "oral pouched tobacco free nicotine product" or "oral pouched nicotine product free from tobacco" and the like refer to a portion of nicotine-containing filling material packed in a saliva-permeable pouch material intended for oral use wherein no tobacco is included in said product.

As used herein the term "oral pouched low tobacco nicotine product" and the like refers to a portion of nicotine-containing filling material packed in a saliva-permeable pouch material intended for oral use wherein an amount of tobacco material within the range of from about 0.1% to about 10% by weight or from about 0.1% to about 5% by weight, based on the total weight of the filling material, is included in said product.

As used herein, the term "moisture content" refers to the total amount of oven volatile ingredients, such as water and other oven volatiles (e.g. propylene glycol) in the preparation, composition or product referred to. The moisture content is given herein as percent by weight (wt %) of the total weight of the preparation, composition or product referred to. As used herein, percent by weight, weight percent and wt % may be used interchangeably.

The moisture content as referred to herein may be determined by using a method based on literature references Federal Register/vol. 74, no. 4/712-719/Wednesday, Jan. 7, 2009/Notices "Total moisture determination" and AOAC (Association of Official Analytical Chemics), Official Methods of Analysis 966.02: "Moisture in Tobacco" (1990), Fifth Edition, K. Helrich (ed). In this method, the moisture content is determined gravimetrically by taking 2.5±0.25 g sample and weighing the sample at ambient conditions, herein defined as being at a temperature of 22° C. and a relative humidity of 60%, before evaporation of moisture and after completion of dehydration. Mettler Toledo's Moisture Analyzer HB43, a balance with halogen heating technology, is used (instead of an oven and a balance as in the mentioned literature references) in the experiments described herein. The sample is heated to 105° C. (instead of 99.5±0.5° C. as in the mentioned literature references). The measurement is stopped when the weight change is less than 1 mg during a 90 seconds time frame. The moisture content as weight percent of the sample is then calculated automatically by the Moisture Analyzer HB43.

"Flavour" or "flavouring agent" is used herein for a substance used to influence the aroma and/or taste of the nicotine product, including, but not limited to, essential oils, single flavour compounds, compounded flavourings, and extracts.

The term "d50" intends the average diameter of a particle size distribution of a group of particles. i.e. the value of the average particle diameter in a cumulative distribution with respect to volume. For example, if d50=0.8 μm/mm, then 50% of the particles in the sample are larger than 0.8 μm/mm, and 50% smaller than 0.8 μm/mm. In a further example, if d10=0.8 mm, then 10% of the particles in the sample are smaller than 0.8 mm, and 90% larger than 0.8 mm.

The sphericity, which may be denominated "5", is a measurement of how close a particle is to be a mathematically perfect sphere. The sphericity S is the ratio of the perimeter of the equivalent circle, $P_{EQPC}$, to the real perimeter, $P_{real}$. The perimeter of the equivalent circle, $P_{EQPC}$, is the perimeter of a circle that has the same area as the projection area of the particle using e.g. image analysis. In this context, the projection area is the area resulting from a two-dimensional projection of the three-dimensional particle. The sphericity value S may be from 0 to 1. A particle having a sphericity value S equal to 1 has the shape of a sphere. The sphericity may be calculated based on measurement using image analysis on a sample of particles, wherein the projected area A and the projected real perimeter $P_{real}$ are recorded. The particles may be projected in the same plane. For instance, the particles may be dispersed in a dispersing unit and then measured as shown in FIG. 8. The image analysis may be performed using an instrument from Symantec as described herein. FIG. 7 shows the following equation that may be used to calculate the sphericity S:

$$S = \frac{P_{EQPC}}{P_{real}} = \frac{2\sqrt{\pi \cdot A}}{P_{real}} \quad \text{Equation (1)}$$

The diameter of the particles described herein may be the diameter of a circle of equal projection area. This is the diameter of a circle that has the same area as the projection area of the particle. In this context, the projection area is the area resulting from two-dimensional projection of the three-dimensional particle. As used herein, $x_{EQPC}$ refers to the diameter of a circle of equal projection area. FIG. 7*a* shows a two-dimensional projection of a three dimensional particle having a projection area A. FIG. 7*b* shows the two-dimensional projection of FIG. 7*a* converted into a circle of equal, i.e. the same, projection area A as the projection of FIG. 7*a*. The diameter of the circle of equal projection area, $x_{EQPC}$, is indicated in the circle of FIG. 7*b*. Image analysis may be used for determining the diameter of the particles described herein. For instance, the image analysis may be performed using an instrument from Sympatec as described herein. For instance, the particles described herein may pass through a mesh having a mesh size from about 35 to about 10. This corresponds to a mesh size range from about 0.5 millimeters to about 2.0 millimeters.

BRIEF DESCRIPTION OF THE DRAWINGS

FIG. 7*a* shows a two-dimensional projection of a three-dimensional particle having a projection area A.

FIG. 7*b* shows a circle of equal projection area A as the particle of FIG. 7*a*.

FIG. 7*c* shows an equation for calculating sphericity for a particle having a real perimeter $P_{real}$ and a projection area A.

DETAILED DESCRIPTION

Figure 1:
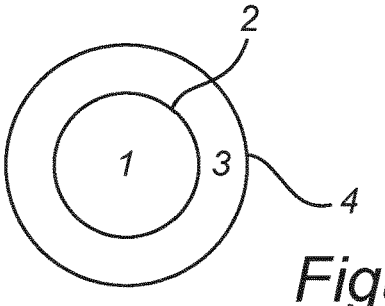
FIG. 1 shows a nicotine-containing particle comprising a core 1 and a first coating 3.

The present disclosure provides an oral pouched nicotine product comprising a filling material and a saliva-permeable pouch of a packaging material enclosing the filling material, the filling material comprising:

particles having a sphericity from about 0.8 to about 1.0 and a diameter from about 0.2 mm to about 2.0 mm, each of said particles comprising:

(i) a core having an outer surface, (ii) a first coating comprising a binder and a nicotine source, said first coating being applied on at least part of the outer surface of said core, and optionally a tobacco material within the range of from about 0.05 wt % to about 10 wt %, based on the total weight of the filling material.

The core may comprise a material selected from the group consisting of cellulose, starch, polyalcohol, sugar and any combinations thereof. Further, the particles may be provided in an amount within the range of from about 50 wt % to about 100 wt %, such as from about 50 wt % to about 90 wt %, based on the total weight of the filling material.

Thus, there is provided an oral pouched nicotine product comprising a filling material and a saliva-permeable pouch of a packaging material enclosing the filling material, said filling material comprising:

particles having a sphericity from about 0.7 to about 1.0, such as from about 0.8 to about 1.0, and a diameter from about 0.1 mm to about 2 mm, such as from about 0.2 mm to about 2.0 mm, each of said particles comprising:

(i) a core having an outer surface, said core comprising a material selected from the group consisting of cellulose, starch, polyalcohol, sugar and any combinations thereof, (ii) a first coating comprising a saliva-soluble binder and a nicotine source, said first coating being applied on at least part of the outer surface of said core, wherein said particles are provided in an amount within the range of from about 50 wt % to about 100 wt %, such as from about 50 wt % to about 90 wt %, based on the total weight of said filling material, and optionally a tobacco material within the range of from about 0.05 wt % to about 10 wt %, based on the total weight of the filling material.

The oral pouched nicotine product may comprise no tobacco, i.e. it may be free from tobacco. Thus, there is provided an oral pouched nicotine product as described herein that is free from tobacco.

Alternatively, the filling material may comprise a tobacco material such as a tobacco material within the range of from about 0.05% to about 10% by weight, such as from about 0.05% to about 5% by weight, such as from about 0.05% to about 0.5% by weight, such as from about 0.05% to about 0.3% by weight, based on the total weight of the filling material. Thus, an oral pouched nicotine product comprising the aforementioned filling material including tobacco may be a low tobacco oral pouched nicotine product. The tobacco material may be mixed with the filling material to provide a mixture such as a homogenous mixture. The tobacco material may be a purified tobacco material, such as a bleached tobacco material. Further, the tobacco material may be provided as tobacco fibers, ground tobacco and/or as snuff such as snus.

It will be appreciated that the filling material particles described herein may be free from tobacco material. In other words, the tobacco material, if present, may not form part of the filling material particles. Additionally, if tobacco material is present in the filling material it may form a mechanical mixture with the filling material particles. As used herein, a mechanical mixture intends a mixture of components wherein the components may be separated from each other.

The particles of the oral pouched nicotine product may be provided in an amount from about 50 wt % to about 99.5 wt %, such as from about 50 wt % to about 95 wt %, such as from about 50 wt % to about 90 wt %, such as from about 50 wt % to about 80 wt %, such as from about 50 wt % to about 70 wt %, such as from about 50 wt % to about 60 wt %, based on the total weight of the filling material.

The shape of the filling material particles may be spherical or substantially spherical. Spherical particles are understood to have a sphericity of 1.0 or about 1.0. Substantially spherical particles are understood to have a sphericity below 1.0 such as from about 0.7 to about 1.0, such as from about 0.80 to about 0.95, such as from about 0.85 to about 1.0, such as from about 0.9 to about 1.0. All or substantially all of the particles described herein may have a sphericity from about 0.7 to about 1, such as from about 0.8 to about 1.0, such as from about 0.8 to about 0.95. For instance, 80 wt % or more of the filling material particles, such as 90 wt % or more, based on the total weight of the filling material may have a sphericity from about 0.7 to about 1, such as from about 0.8 to about 1.0, such as from about 0.8 to about 0.95 such as from about 0.85 to about 1.0, such as from about 0.9 to about 1.0.

The particles of the filling material as described herein may all have the same or substantially the same size. As used herein, the expression "the same size" intends particles varying in same size diameter by ±30% or less, such as ±20% or less, such as ±10% or less. For instance, 80% or more of the particles may have the same size, such as 90% or more.

Figure 8:
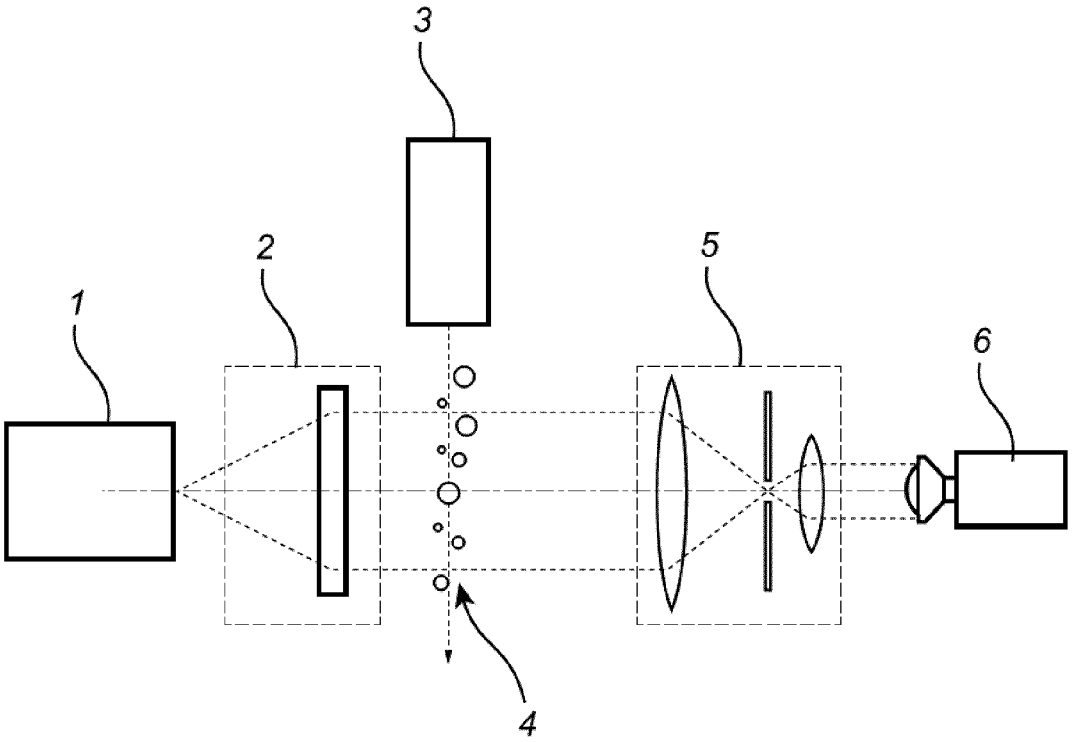
FIG. 8 shows an image analysis instrument for measurement of particles.

The particle size described herein may be measured by image analysis. For instance, image analysis may be performed using an instrument from Sympatec as described herein. Such an instrument may operate as shown in FIG. 8, wherein 1 is a pulsed light source, 2 is a beam expansion unit adaptable to measuring range, 3 is a dispersing unit, 4 is particle flow, 5 is an objective and 6 is a camera. A well dispersed particle flow is led through the image plane. The particles are separated from each other by a transportation fluid and overlapping particles are avoided. A high number of particle numbers per image frame may be captured.

The particles of the filling material particles may have a diameter from about 0.1 mm to about 2.0 mm, such as from about 0.2 mm to about 2.0 mm, such as from about 0.5 mm to about 2.0 mm, such as from about 0.6 mm to about 2.0 mm, such as from about 0.7 mm to about 2.0 mm, such as from about 0.8 mm to about 2.0 mm, such as from about 0.9 mm to about 2.0 mm, such as from about 0.5 mm to about 1.5 mm, such as from about 0.7 mm to about 1.5 mm, such as from about 0.9 mm to about 1.2 mm. For instance, the particles may have a diameter from about 0.5 mm to about 1.5 mm.

Further, the particles of the filling material may have a d50 value within the range of from about 0.5 mm to about 1.5 mm, such as from about 0.7 mm to about 1 mm, such as from about 0.8 to about 1 mm, such as about 0.7 mm, such as about 0.8 mm, such as about 0.9 mm, such as about 1.0 mm. For instance, the particles of the filling material may have a d50 value within the range of from about 0.3 mm to about 1.5 mm, such as from about 0.7 mm to about 1 mm, such as from 0.8 mm to about 1 mm. In a further example, the d50 may be about 0.2, about 0.3, about 0.5, about 0.6, about 1.2, about 1.5 or about 2.0. This value may vary by ±30% or less.

The particles of the filling material described herein may have a diameter within the range of from about 0.8 mm to about 1.15 mm and a d50 value of about 0.9.

The outer surface of the particles and/or particle core(s) may be smooth or at least substantially smooth.

The particles of the filling material described herein have been found to have a better fluidity as compared to the fluidity of a powder. As a result, an oral pouched nicotine product enclosing said particles may easily adjust its shape to fit onto or into an object that is contacted with the product such as a place within the oral cavity. Further, the oral pouched nicotine product may be perceived as less dry as compared to an oral pouched nicotine product comprising a powder.

The filling material particle cores may have a sphericity from about 0.8 to about 1.0, such as from about 0.85 to 1.0, such as from about 0.9 to about 1.0 and/or a particle diameter from about 0.2 mm to about 1.8 mm, such as from about 0.2 mm to about 1.5 mm, such as from about 0.2 mm to about 1.0 mm, such as from about 0.2 mm to about 0.5 mm.

The filling material particle cores may have a diameter which comprises or consists of 80% or more of the diameter of the filling material particles.

The filling material particle cores may lack nicotine such as a nicotine source described herein, i.e. the core may be free from nicotine. Alternatively, the core may comprise or consist of a nicotine source as described herein.

Further, the filling material particle cores may be free from internal voids. Alternatively, the filling material particle cores may comprise internal voids. When internal voids are present, these may contain a nicotine source or be free from nicotine source. As used herein, "internal voids" it is meant internal compartments, such as pores. Thus, the filling material particle core(s) may be porous or non-porous. In an example, the filling material comprises particles comprising porous cores, particles comprising non-porous cores or a mixture of said particles.

Further, the filling material particle cores may comprise or consist of a saliva-soluble material and/or a saliva non-soluble material. For instance, filling material particle cores may comprise or consist of a saliva-soluble material optionally together with a saliva non-soluble material. In a further example, the filling material particle core may comprise about 80 wt % or more of a saliva-insoluble material, such as about 90 wt % or more, such as about 100 wt %, based on the total weight of the core or the core material.

The material of the particle cores of the filling material particles may be selected from the group consisting of cellulose, starch, polyalcohol and sugar; such as microcrystalline cellulose, isomalt and/or maltitol. For instance, the material of the particle cores of the filling material particles may comprise or consist of microcrystalline cellulose and optionally isomalt and/or sugar. In yet a further example, the material of the particle cores of the filling material particles may comprise or consist of microcrystalline cellulose.

The material of the filling material particle core(s) may constitute from about 80 wt % to about 100 wt %, such as from about 90 wt % to about 100 wt %, such as about 100 wt %, of the total weight of the core(s).

The first coating is applied on at least part of the outer surface of said cores. For instance, the first coating may be applied on the entire part of the outer surface of the filling material particle cores. The first coating may have a uniform or non-uniform thickness. In an example, the first coating comprises a uniform or substantially uniform thickness in the range from about 10 μm to about 100 μm, such as from about 25 μm to about 50 μm. The application of the first coating to the particle core(s) allows for providing a substantially smooth particle outer surface, a desired particle shape such as a spherical or substantially spherical shape and/or a desired fluidity. Further, application of the first coating on the particle core optionally provided with a second coating as described herein distributes the nicotine source over a larger surface as compared to a nicotine source adhering to one or more particles having a smaller size such as particles of a powder, which may aid in increasing nicotine release such as the initial nicotine release when the product is used in the oral cavity of a consumer. Moreover, all or substantially all of the nicotine source of the first coating may be released upon use without crushing of the nicotine-containing particles thereby maximizing the use of the nicotine source without e.g. mastication or chewing.

The first coating comprises or consists of a binder and a nicotine source. The binder and the nicotine source may be mixed such as homogenously mixed. Thus, the first coating may comprise or consist of a homogenous mixture of the binder and the nicotine source. Advantageously, the binder is saliva-soluble thereby allowing the nicotine source to be released when the first coating is contacted with saliva such as human saliva. The binder may be selected from the group consisting of hydroxypropyl methylcellulose (HPMC), hydroxypropyl cellulose (HPC), methyl cellulose (MC), polyvinylpyrrolidone (PVP) and any mixture thereof. The binder may further comprise Kollidon, i.e. polyvinylpyrrolidine, and/or polyethylene glycol (PEG). In addition to functioning as a binder, the binder allows for protecting the nicotine source from being degraded, imparting a desired release rate of the nicotine source and/or ensuring that the nicotine source is placed in a desired location. Further, the binder may prevent the nicotine source from being sorbed to the particle core. Moreover, the binder may be in mixture with the nicotine source, such as a homogenous mixture, thereby preventing the nicotine source from being degraded upon storage such as storage taking place at a relative humidity from about 60% to about 75%, at a temperature from about 22° C. to about 30° C., and/or for a time about 15 weeks.

The nicotine source of the first coating and optionally the particle cores described herein may be a nicotine salt and/or nicotine base such as a nicotine source selected from the group consisting of nicotine hydrochloride, nicotine dihydrochloride, nicotine monotartrate, nicotine bitartrate, nicotine bitartrate dihydrate, nicotine sulphate, nicotine zinc chloride monohydrate and nicotine salicylate, nicotine benzoate, nicotine polacrilex and any combination thereof. For instance, the nicotine source may be one or more of the following: nicotine monotartrate, nicotine bitartrate, nicotine bitartrate dihydrate. In particular, the nicotine source may be nicotine bitartrate dihydrate.

The amount of nicotine per pouched product, i.e. the amount of nicotine source per pouched product, may be within the range from about 0.1 mg to about 20 mg of nicotine calculated as nicotine base, such as about 0.5 mg, about 1.0 mg, about 1.5 mg, about 2.0 mg, about 2.5 mg, about 3.0 mg, about 3.5 mg, about 4.0 mg, about 4.5 mg, about 5.0 mg, about 6.0 mg, about 7.0 mg, about 8.0 mg, about 9.0 mg, about 10 mg, about 12 mg, about 14 mg, about 16 mg, about 18 mg, or about 20 mg of nicotine.

The particles of the filling material as disclosed herein may further comprise a second coating. The second coating may be applied on the outer surface of the particle core. As a result, the outer surface of the particle core will comprise the second coating. It follows that the second coating may be located between the core and the first coating and cover part or all of the outer surface of the core. Additionally or alternatively, the second coating may be applied on at least part of an outer surface of the first coating such as over the entire outer surface of the first coating. The thickness of the second coating may be uniform or non-uniform. The thickness may be from about 10 μm to about 100 μm.

Application of the second coating on the particle cores may impart a desired shape to the nicotine source and any additives from being sorbed to the core. Further, application of the second coating on an outer surface of the first coating may improve the fluidity of the resulting particulate material and/or may aid in controlling the release rate of the nicotine source and any optional additives from the first coating.

The second coating may comprise a binder such as a saliva-soluble binder. It will be appreciated that the saliva-soluble binder will dissolve when it is contacted with a saliva such as human saliva. The binder may be selected from the group consisting of hydroxypropyl methylcellulose (HPMC), hydroxypropyl cellulose, methyl cellulose (MC), polyvinylpyrrolidone and any mixture thereof. Further, the second coating may comprise an additive as described herein. For instance, the second coating may comprise a pH adjusting agent as described herein. In this way, the pH adjusting agent may be kept separate from the nicotine source in the first coating thereby reducing the risk for degradation of the nicotine source. Alternatively, the second coating may lack an additive such as an additive described herein. It will be appreciated that the second coating may lack a nicotine source, i.e. it may be nicotine free.

It will be appreciated that the first coating and/or the second coating described herein may be saliva-soluble. As used herein, saliva-soluble means that all or substantially all of the component or material referred to will dissolve when it is contacted with saliva such as human saliva. The component or material referred to may dissolve partly, such as to an extent of about 60 wt % or more, based on the total weight of the component or material, or entirely within a time period of about 2 hours, such as about 1 hour, such as about 30 minutes, such as about 10 minutes, such as about 5 minutes upon placement in the oral cavity of a consumer.

The thickness of the first coating optionally together with the second coating may be small as compared to the particle core diameter. For instance, said thickness may constitute or comprise 20% or less of the particle diameter. Moreover, the major part of the particle core material may be saliva-insoluble. For instance, 80 wt % or more of the particle core material may be saliva-insoluble, such as 90 wt % or more, such as 95 wt % or more, such as 100 wt %, based on the total weight of the core or core material. As used herein, saliva-insoluble means that the component or material referred to does not dissolve or substantially does not dissolve when contacted with saliva such as human saliva. For instance, 10 wt % or less of the component or material may dissolve upon contact with saliva, such as upon contact with saliva during a time period such as 2 hours, such as 1 hour, such as 30 minutes. As a result, the size and shape of the nicotine-containing particles may remain substantially unchanged when they are contacted with a saliva such as human saliva. Therefore, the mouth feeling experienced by a consumer using the product in the oral cavity may remain substantially unchanged over time.

The filling material as disclosed herein may further comprise nicotine free particles and/or nicotine-containing particles wherein the nicotine is located in the core only. These particles may be the same or substantially the same as the particles of the filling material except that they lack a nicotine-containing coating, i.e. they are free from a coating comprising a nicotine source. Alternatively, these particles may be different from the particles of the filling material. These particles may comprise an additive as described herein, lack an additive as described herein or include a mixture of said additives. These particles may lack or comprise one or more coatings, which may comprise or be free from an additive such as an additive described herein. These particles may serve as an additional filling material. The size, density and/or shape of these nicotine free particles and/or nicotine-containing particles wherein the nicotine is located in the core only may be the same or different from that of the particles of the filling material. Advantageously, the density of these nicotine free particles and/or nicotine-containing particles wherein the nicotine is located in the core only may be the same or substantially the same as that of the particles of the particles of the filling material since this minimizes the risk for segregation when the oral pouched nicotine product is stored.

The filling material as described herein may further comprise an additive selected from the group consisting of a pH adjusting agent, a flavouring agent, a sweetener, a humectant and any mixture thereof.

The additive as disclosed herein may be

- sorbed to the nicotine free particles and/or nicotine-containing particles wherein the nicotine source is located in the particle core only,
- included in the first coating,
- included in the second coating, and/or
- sorbed to the particle cores.

When the additive is a pH adjuster it may be included in the first coating and/or in the second coating. Additionally or alternatively, the pH adjuster may be sorbed to the nicotine free particles as described herein and/or nicotine-containing particles wherein the nicotine is located in the core only as described herein.

As used herein, the expression "sorbed to" intends "adsorbed to" or "absorbed to". It will be appreciated that "adsorbed to" intends the adhesion of a component such as a nicotine source or an additive as described herein to an outer surface of a particle or particle core. Further, "absorbed to" intends the inclusion of a component such as a nicotine source or an additive as described herein within a cavity such as a pore of a particle or particle core.

The pH adjusting agent of the oral pouched nicotine product as described herein allows the pH to be within the range of from about 7 to about 10. This pH may be achieved after manufacture of the product, such as immediately after manufacture of the product.

Further, this pH is provided upon storage of the product such as upon storage at room temperature, or in a refrigerator at approximately from 5° C. to 10° C. Achieving a pH within the range of about 7 to about 10, such as from about 7 to about 9.5, such as from about 7 to about 9.2, such as from about 7 to about 9, such as from about 8 to about 9, is advantageous since it allows for good nicotine uptake and/or extraction, and taste while not impacting oral mucous membranes negatively.

The amount of pH adjusting agent may be selected such that the filling material when dispersed in purified water provides a pH above 7.0, such as a pH within the range of from about 7.0 to about 10.0 or a pH within the range of from about 8.0 to about 9.0, such as a pH within the range of from about 8.3 to about 8.7.

The pH of the filling material can be measured by adding 100 ml of distilled water to 5.0 gram of filling material, for instance in a 100 ml Erlenmeyer flask, stirring the resulting mixture at room temperature with a magnetic stirrer at 100 rpm for about 5 minutes, and then measuring the pH of an extract obtained therefrom with a calibrated (according to the manufacturer's instructions) pH meter. For correctness of readings, the sample solutions shall be analyzed within one hour. In this document, the term "rpm" stands for revolutions per minute. Further, in this document the expression "room temperature" stands for a temperature from about 20° C. to about 25° C. such as about 22° C.

Examples of suitable pH adjusting agents include sodium hydroxide, potassium hydroxide, potassium carbonate, sodium carbonate, sodium bicarbonate, potassium bicarbonate, magnesium carbonate and any combination thereof. For instance, the pH adjusting agent may be potassium hydroxide. In a further example, the pH adjusting agent may be sodium carbonate, potassium carbonate, sodium bicarbonate and/or potassium bicarbonate.

The pH adjusting agent may be included in the first coating, in the second coating and/or sorbed to nicotine free particles such as particles that are free from a coating comprising a nicotine source. By keeping a part or all of the pH adjusting agent separate from the nicotine source the storage stability of the nicotine source may improve since a high pH may have a negative effect on the stability of the nicotine source.

The filling material may comprise one or more flavouring agents. For instance, the flavouring agent may be a liquid, an oil, a solid such as a particulate material or a mixture thereof.

The flavouring agent may be stable at pH >7. Further, the flavouring agent of the filling material in the oral pouched nicotine product as described herein may be a hydrophobic flavouring agent.

Examples of flavours include bergamot, eucalyptus, orange, mandarin, citrus, lemon, peppermint, spearmint, mint, menthol, liquorice, wintergreen, whiskey, rum, cherry, various berries, tobacco, coffee, vanilla, lime, apple, peach, carvone, limonene and any combination of two or more thereof.

The filling material of the oral pouched nicotine product as described herein may comprise within the range of from about 0.5% to about 3.0% by weight of the flavouring agent, based on the total weight of the filling material.

The flavouring agent may be included in the first coating together with the binder and nicotine source. Additionally or alternatively, the flavouring agent may be provided in admixture with the filling material such as to form a mechanical mixture or mass, incorporated into the second coating as described herein, incorporated into nicotine free particles such as nicotine free particles as described herein and/or added to a container comprising the oral pouched nicotine product described herein.

Addition of the flavouring agent to the oral pouched nicotine product described herein may be achieved by adding said flavouring agent to an inside surface of a container for the oral pouched nicotine product such as a can, and allowing said flavouring agent to diffuse or migrate from the inside surface to the oral pouched nicotine product. Thus, the present disclosure also provides a method for adding a flavouring agent as described herein to an oral pouched nicotine product as described herein, said method comprising the steps of:

applying the flavouring agent onto at least one inside surface of a container for the oral pouched nicotine product, placing the oral pouched nicotine product in the container, and closing the container.

The container may be a packaging and/or consumer container suitable for oral pouched nicotine products. Thus, the container described herein may be adapted for being conveniently carried in a consumer pocket or handbag, and/or may also be used for packaging any known type of snuff product such as oral pouched nicotine products as described herein. The container may be made of plastics and/or metal. Further, the container may have any desired shape or geometrical form. For example, the container may have the form of a cylinder. The container may comprise a top and a base defining an interior space. The base may comprise a base surface and surrounding walls extending from said base surface. The top may be in the form of a lid that is detachable from the base of the container, or in the form of a lid that is hinged or otherwise attached to the base of the container. For example, the lid may be attached by to the base by snap-fit. The container may be tamper resistant. In an example, the container may be as described in WO 2017/125405 which is incorporated herein in its entirety. In a further example, the container may be as shown in the Design Registration in Norway No. 085548.

From a manufacturing point of view, it may be desirable to apply the flavouring agent to the bottom inner surface of the base and/or the top inner surface of the lid. The container is thereafter closed.

Flavourization may take place during storage for a certain time such as a week. The storage may take place at room temperature, i.e. from about 20° C. to about 25° C., or in a refrigerator from about 5° C. to about 10° C. During the storage time, the flavouring agent diffuses or migrates from the at least one inside surface of the container to the oral pouched nicotine product.

Accordingly, the method for adding a flavouring agent may further comprise a step of:

storing the container for a week.

The filling material may also comprise a sweetener such as natural or synthetic sweeteners. Examples of sweeteners include sucrose, glucose, dextrose, maltose, fructose, saccharin, aspartame, acesulfame, sucralose, cyclamate and any mixture thereof.

The sweetener may be comprised within the first coating together with the binder and nicotine source. Additionally or alternatively, the sweetener may be provided in admixture with the filling material such as to form a mechanical mixture or mass, incorporated into a second coating as described herein and/or incorporated into nicotine free particles such as nicotine free particles as described herein.

The filling material as disclosed herein may further comprise water in an amount from about 1 wt % to about 50 wt %, such as from about 20 wt % to about 45 wt %, such as from about 1 wt % to about 20 wt %, such as about from 1 wt % to about 10 wt %, such as about 20 wt %, such as from about 1 wt % to about 3 wt % based on the total weight of the filling material. For instance, the filling material comprises from about 1 wt % to about 5 wt % of water based on the total weight of the filling material.

There is also provided a method for preparing nicotine-containing particles as disclosed herein comprising the steps of:

providing particle cores having an outer surface as described herein, applying a first coating as described herein on the outer surface of said particle cores, and optionally applying a second coating as described herein on the outer surface of said particle cores and/or on an outer surface of the first coating, and optionally removing small particles such as particles having at least one dimension that is about 150 micrometer, such as about 50 micrometer, or less.

The removal of the small particles may be performed by using a mesh. It is understood that application of the second coating on the outer core surface provides an outer core surface comprising the second coating.

For instance, there is provided a method for preparing nicotine-containing particles as disclosed herein comprising the steps of:

a) providing particle cores having an outer surface as described herein, b) applying a first coating as described herein on the outer surface of said particle cores, c) optionally applying a second coating as described herein on an outer surface of the first coating, and d) optionally removing small particles such as particles having at least one dimension that is about 150 micrometer, such as 50 micrometer, or less.

In a further example, there is provided a method for preparing nicotine-containing particles as disclosed herein comprising the steps of:

a) providing particle cores having an outer surface as described herein, b) applying a second coating as described herein on the outer surface of said particle cores, c) applying a first coating as described herein on an outer surface of the second coating, d) optionally applying a further second coating on an outer surface of the first coating, and d) optionally removing small particles such as particles having at least one dimension that is about 150 micrometer or less.

It will be appreciated that the composition of the second coating and the further second coating may be the same or different.

Advantageously, the manufacture of the nicotine-containing particles includes removal of small particles such as particles which have at least one dimension that is smaller than 150 micrometers. Accordingly, the resulting nicotine-containing particles are dust free or at least dust reduced. This lack of dust or substantial lack of dust is a significant advantage in the manufacture of an oral pouched product as described herein since dust has a negative impact on the pouch seal strength. Thus, the nicotine-containing particles described herein allow for improving the pouch seal strength. Accordingly, it is understood that the present disclosure may provide an oral pouched nicotine product which is free from particles having at least one dimension that is smaller than about 150 micrometers, such as 50 micrometer, or less.

The first coating and, when present, the second coating may be applied to the particle cores by e.g. using a coating fluid bed spraying.

There is also provided nicotine-containing particles as disclosed herein which are obtainable or obtained by a method as disclosed herein.

Examples of nicotine-containing particles of the present disclosure will now follow. It is understood that the core, the first coating and, when present, the second coating may be as described herein.

FIG. 1 shows a spherical nicotine-containing particle, wherein the core 1 has a spherical shape and an outer surface 2. A first coating 3 is applied onto the entire part of the outer surface 2 of the core 1. The first coating 3 has an outer surface 4.

Figure 2:
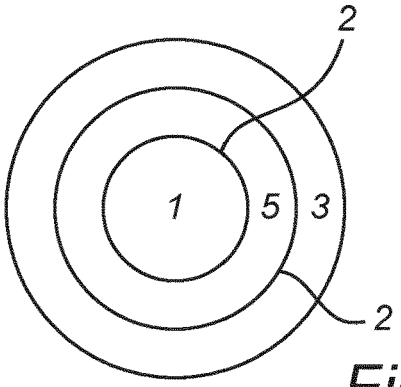
FIG. 2 shows a nicotine-containing particle comprising a core 1 and a first coating 3, said first coating 3 being separated from the core 1 by a second coating 5.

FIG. 2 shows a spherical nicotine-containing particle, wherein the core 1 has a spherical shape and an outer surface 2. A second coating 5 is provided on the entire outer surface 2 of the core 1 whereby the outer surface 2 comprises said second coating. A first coating 3 is applied on the entire outer surface 2 comprising the second coating 5. Thus, the second coating 5 is located between the core 1 and the first coating 3.

Figure 3:
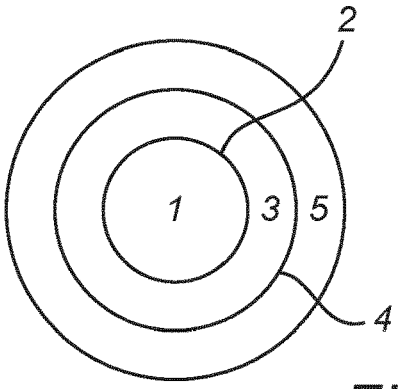
FIG. 3 shows a nicotine-containing particle comprising a core 1, a first coating 3 and a second coating 5, said second coating 5 being applied on the first coating 3.

FIG. 3 shows a spherical nicotine-containing particle, wherein the core 1 has a spherical shape and an outer surface 2. A first coating 3 is applied onto the entire part of the outer surface 2 of the core 1. The first coating 3 has an outer surface 4. A second coating 5 is applied on the entire outer surface 4 of the first coating 3.

Figure 4:
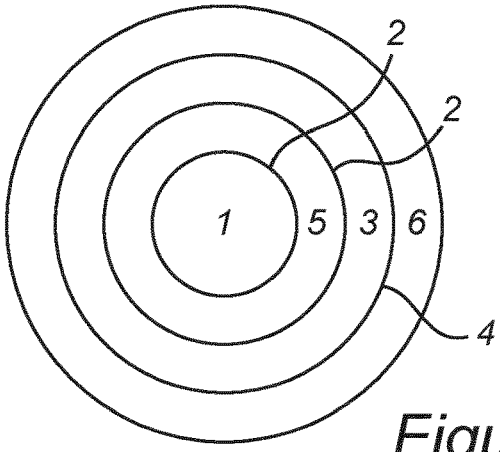
FIG. 4 shows a nicotine-containing particle comprising a core 1, a first coating 3, a second coating (5 and a further second coating 6.

FIG. 4 shows a spherical nicotine-containing particle, wherein the core 1 has a spherical shape and an outer surface 2. A second coating 5 is provided on the entire outer surface 2 of the core 1 whereby the outer surface 2 comprises said second coating 5. A first coating 3 is applied on the entire outer surface 2 comprising the second coating 5. Thus, the second coating 5 is located between the core 1 and the first coating 3. The first coating 3 has an outer surface 4. A further second coating 6 is applied on the entire outer surface 4 of the first coating 3. Thus, the first coating 3 is located between the second coating 5 and the further second coating 6. The composition of the second coating 5 and the further second coating 6 may be the same or different. For instance, the second coating 5 may comprise a binder and an additive, and the further second coating 6 may consist of a binder, or vice versa.

Further, there is provided a method for providing an oral pouched nicotine product, said method comprising the steps of:

a) providing a filling material as described herein, and b) enclosing said filling material in a saliva-permeable pouch.

The nicotine-containing particles of the filling material may be prepared as described herein, and optionally be mixed with additives and/or tobacco material as described herein. Further, the filling material may be flavourized as described herein. The step of enclosing the filling material in a saliva-permeable pouch may take place by measuring portions of the filling material and inserting the portions into a pouch There is also provided an oral pouched nicotine product as disclosed herein which is obtainable or obtained by a method as disclosed herein.

The pouch of the oral pouched nicotine product may be made of any suitable saliva-permeable, and preferably non-dissolvable, packaging material, such as a non-woven material. The packaging material—herein also called pouch material—may be a nonwoven material comprising staple fibres of regenerated cellulose, such as viscose rayon staple fibres, and a binder, such as a polyacrylate. The packaging material may also comprise additional ingredients, such as flavouring agents and/or colorants. Further, the packaging material may be a pharmaceutically acceptable material.

In an example, the packaging material of the pouch described herein comprises or consists of a nonwoven material, wherein said packaging material comprises a non-woven material comprising fibres, said fibers having a linear density that are less than about 1.7 decitex, and said non-woven material having a basis weight equal to or above about 30 $g/m^2$. This allows the packaging material to exhibit satisfactory strength, flexibility and/or permeability for saliva and the filling material components.

The oral pouched nicotine product as disclosed herein may have an oblong shape, such as a substantially rectangular shape (as seen from above when the product is placed on a planar surface). In such case, the longitudinal direction of the product corresponds to the length of the substantially rectangular product and the transverse direction of the product corresponds to the width of the substantially rectangular product. The pouch may comprise one or more seals such as a transverse seal and/or a longitudinal seal.

The total weight of the oral pouched nicotine product (including filling material and packaging material) may be within the range of from about 0.2 to about 1.5 g.

The oral pouched (i.e. portion-packed) nicotine products may be positioned randomly in a container or in a pattern, for instance as disclosed in WO 2012/069505. Alternatively or additionally, each oral pouched nicotine product may be placed in a sachet.

The oral pouched nicotine product as disclosed herein is intended for use in the oral cavity, such as by buccal placement (e.g. by placing the pouched product between the upper or lower gum and the lip or cheek), and may therefore be referred to as portion-packed (pouched) nicotine product for oral use, i.e. an oral pouched nicotine product. The oral pouched nicotine product is sized and configured to fit comfortably and discreetly in a user's mouth between the upper or lower gum and the lip or cheek.

The invention will be further described in the following examples, which do not limit the scope of the invention described in the claims.

EXAMPLES

General

Cellets 700 MCC spheres were supplied by Pharmatrans-Sanaq, Switzerland. These spheres are produced solely with microcrystalline cellulose. The powder ZYN Spearmint in this Example section was obtained from Swedish Match and comprised microcrystalline cellulose, maltitol, hydroxypropyl cellulose, flavour additives, pH regulators, sweetener and nicotine bitartrate. The microcrystalline cellulose and maltitol constituted about 84 wt % based on the total weight of the powder. The nicotine bitartrate constituted about 2.5 wt % of the total weight of the powder. The powder had the following D values with respect to volume: d10=125 micrometers, d50=250 micrometers, d90=400 micrometers.

ABBREVIATIONS

The following abbreviations are used throughout this document and their meaning is explained below.

mm millimeter(s)
μm micrometer(s)
g gram(s)
mg milligram(s)
ml milliliter(s)
sec. second(s)
H hour(s)
min. minute(s)
MCC microcrystalline cellulose

Example 1

Coating liquid was prepared by first mixing ethanol and binder (HPC L, supplied by Nisso, Japan) and letting the HPC fully dissolve for 5 hours. Thereafter nicotine bitartrate dihydrate (supplied by Siegfried AG, Switzerland), sodium bicarbonate (supplied by TATA Chemicals, UK) and sodium carbonate (supplied by Novacarb, France) was added according to Table A below. Prior to mixing the particle size of the nicotine bitartrate dihydrate, sodium bicarbonate and sodium carbonate had been reduced by grinding in a mortar for 3 minutes.

TABLE A

| Ingredient | Amount (g) |
|---|---|
| HPC | 14.98 |
| Ethanol | 161.26 |
| Nicotine bitartrate dihydrate | 6.28 |
| Sodium bicarbonate | 5.82 |
| Sodium carbonate | 4.76 |

168.16 g of Cellets 700 MCC spheres (supplied by Pharmatrans-Sanaq, Switzerland) were coated with above coating liquid using a MidiGlatt lab fluid bed equipment (supplied by Glatt, Germany) set up with a wurster insert and the following process parameter settings: inlet air temperature 48-55 C, airflow 40 $m^3$/h, atomizer pressure 1.5 bar, liquid flow 1.7-1.9 g/min. After coating twins and triplets, i.e. two or three particles that stick together, were removed by sifting through 1 mm sieve. Also, fines were removed by sifting on a 500 um sieve.

The coating yield was 62%. As used herein, the coating yield was calculated as follows: Coating yield=(Final weight of product–charged core material)/(charged solid coating material). The resulting coated MCC spheres had a moisture content of 2.6%, a pH value 8.99 and a sphericity of 0.92. The sphericity and d50 value (see below) were calculated with the aid of a QicPic instrument from 2012, Symantec, ID No. 290-D, with Rodos/L dispersion line ID NO 214D and Vibri/L sample feeding ID NO 273. For the sphericity, the standard deviation was 0.01. The d50 of the coated MCC spheres was 940 μm. The thickness of the coating layer was estimated to be about 25 μm, from values of d50 for coated and uncoated MCC spheres. The pH of the coated MCC spheres was measured by adding 100 ml of distilled water to 5.0 gram of the coated MCC spheres, in a 125 ml beaker, stirring the resulting mixture at room temperature with a magnetic stirrer at 100 rpm for about 5 minutes, and then measuring the pH of an extract obtained therefrom with a calibrated (according to the manufacturer's instructions) pH meter. For correctness of readings, the sample solutions were analyzed within one hour.

The sphericity and d50 was measured also for the above-mentioned Cellets 700 MCC spheres using the QicPic instrument. The sphericity was found to be 0.93 with a standard deviation of 0.01. The d50 was found to be 890 μm.

Figure 5:
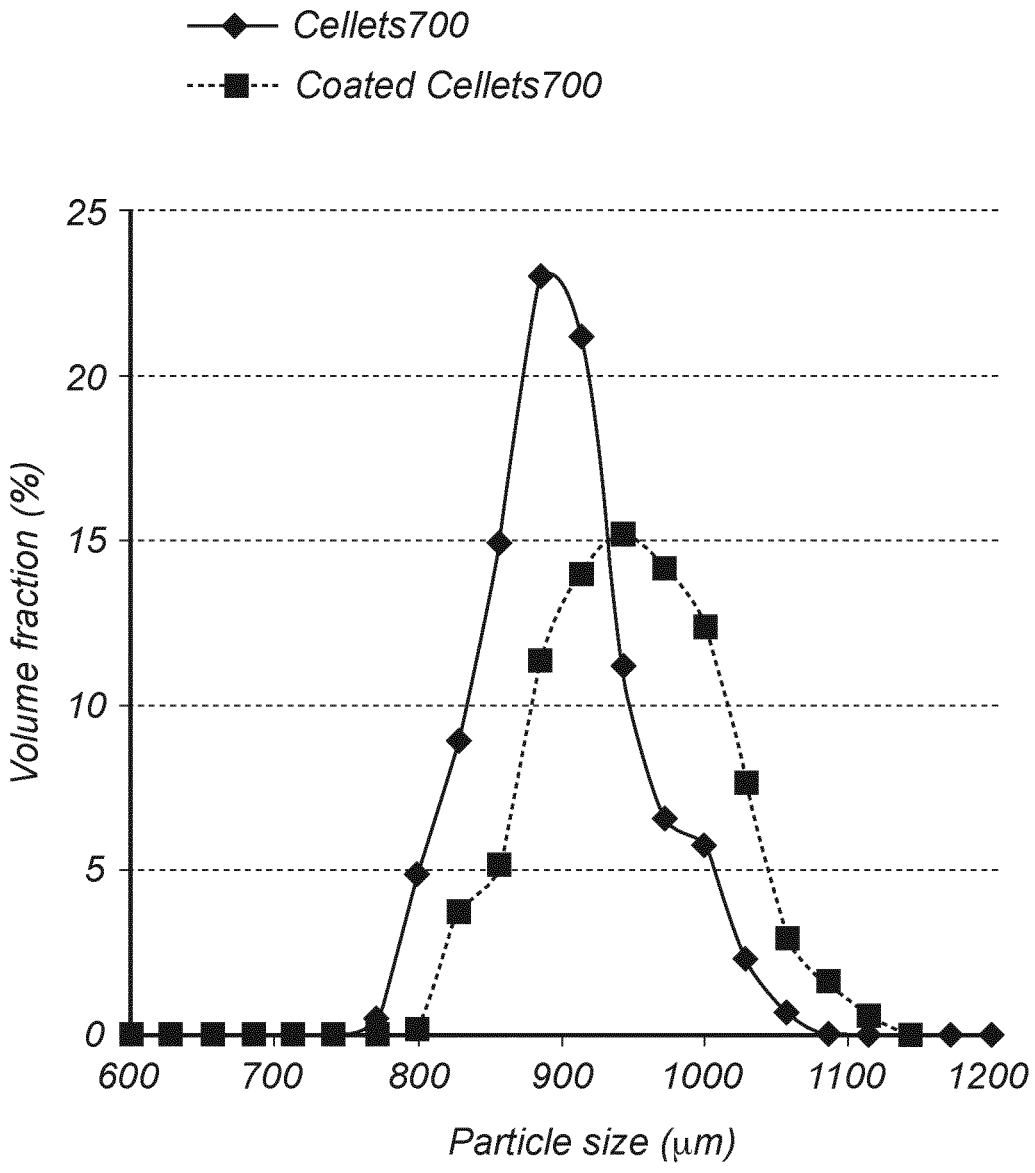
FIG. 5 shows the particle size distribution of uncoated Cellets 700 particles and coated Cellets700 particles, respectively.

FIG. 5 shows the particle size distribution of the uncoated Cellets700 and the coated Cellets700, respectively.

The coated MCC spheres were packed into portion pouches of 0.5-0.6 g each using a water permeable nonwoven pouch material. The pouches were tested by a reference group of 3 people, who found the mouthfeel to be very comfortable compared to oral nicotine containing pouches based on tobacco or non-tobacco powder and that the pouch adjusted its shape easily to be complimentary to the shape of the part of the oral cavity where it was placed while still keeping the pouch volume during use.

Example 2: Flow Test 15 g of coated MCC spheres from Example 1 was poured through a glass funnel with 60 degree inclination and inner diameter of the funnel pipe of 5 mm. The time needed for the spheres to pass the funnel was measured and this procedure was repeated five times. The same procedure was done for granulate powder constituting the pouch filling for ZYN 3 mg Spearmint (produced by Swedish Match). The time needed for the coated spheres and the granulate powder to flow through the funnel was calculated into mass flow using the formula: Mass flow=mass of sample/passage time.

Figure 6:
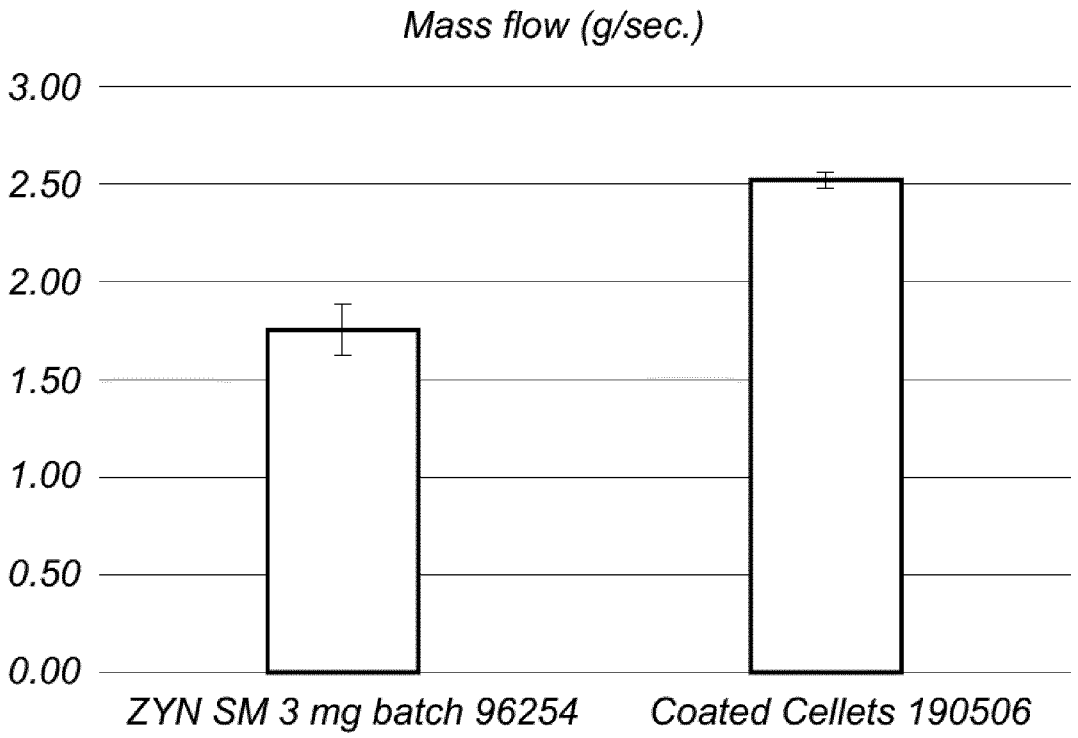
FIG. 6 shows the results of a flow test performed on a nicotine-containing powder and on coated microcrystalline spheres, respectively.

The results are shown in FIG. 6. The mass flow was 44% greater for coated MCC spheres when compared to the granulate powder.

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

The invention claimed is:

1. An oral pouched nicotine product comprising a filling material and a saliva-permeable pouch of a packaging material enclosing the filling material, said filling material comprising:

particles having a sphericity from 0.7 to 1.0, and a diameter from 0.1 mm to 2.0 mm, each of said particles comprising:

(i) a core having an outer surface, said core comprising a material selected from the group consisting of cellulose, starch, polyalcohol, and sugar, or any combinations thereof, (ii) a first coating comprising a binder and a nicotine source, said first coating being applied on at least part of the outer surface of said core, wherein said particles are provided in an amount within the range of from 50 wt % to 100 wt % based on the total weight of said filling material, and wherein the filling material is free from tobacco material or comprises a tobacco material within the range of from 0.05 wt % to 10 wt %, based on the total weight of the filling material.

2. The oral pouched nicotine product according to claim 1, wherein said particles have a d50 value within the range of from 0.3 mm to 1.5 mm.

3. The oral pouched nicotine product according to claim 1, wherein said particles have a sphericity from 0.8 to 1.0 and a diameter from 0.2 mm to 2.0 mm.

4. The oral pouched nicotine product according to claim 1, wherein said core is free from nicotine.

5. The oral pouched nicotine product according to claim 1, wherein 80 wt % or more of the material of said core is saliva-insoluble based on the total weight of the material of the core.

6. The oral pouched nicotine product according to claim 1, wherein said material of said core is selected from the group consisting of cellulose, starch, polyalcohol, and sugar; and/or wherein the material of said core comprises or consists of microcrystalline cellulose, isomalt and/or maltitol; and/or wherein the material of said core comprises or consists of microcrystalline cellulose.

7. The oral pouched nicotine product according to claim 1, wherein said particles and/or said core have/has a sphericity from 0.8 to 1.0.

8. The oral pouched nicotine product according to claim 1, wherein said core has a diameter which comprises 80% or more of the diameter of said particles.

9. The oral pouched nicotine product according claim 1, wherein said first coating has a uniform thickness, wherein said thickness optionally comprises 20% or less of the diameter of said particles.

10. The oral pouched nicotine product according to claim 1, wherein the binder is in mixture with the nicotine source, thereby preventing the nicotine source from being degraded upon storage taking place at a relative humidity from 60% to 75%, at a temperature from 22° C. to 30° C., and for a time of 15 weeks.

11. The oral pouched nicotine product according to claim 1, wherein said first coating is saliva-soluble.

12. The oral pouched nicotine product according to claim 1, wherein said binder in said first coating is selected from the group consisting of hydroxypropyl methylcellulose, hydroxypropyl cellulose, and polyvinylpyrrolidone, or any combination thereof.

13. The oral pouched nicotine product according to claim 1, wherein said nicotine source is a nicotine salt and/or nicotine base.

14. The oral pouched nicotine product according to claim 1, wherein said nicotine source is one or more of the following: nicotine monotartrate, nicotine bitartrate, or nicotine bitartrate dihydrate.

15. The oral pouched nicotine product according to claim 1, wherein the amount of the nicotine source is within the range of from 0.1 mg to 20 mg of nicotine calculated as nicotine base.

16. The oral pouched nicotine product according to claim 1, wherein said particles further comprise a second coating located between said core and said first coating and/or on top of said first coating.

17. The oral pouched nicotine product according to claim 1, wherein said filling material further comprises particles that are free from a coating comprising a nicotine source.

18. The oral pouched nicotine product according to claim 17, wherein said particles that are free from a coating comprising a nicotine source have the same size as the particles comprising the nicotine source.

19. The oral pouched nicotine product according to claim 1, wherein said filling material further comprises an additive selected from the group consisting of a pH adjusting agent, a flavouring agent, a sweetener, and a humectant, or any mixture thereof.

20. A method for preparing an oral pouched nicotine product as defined in any one of the preceding claims, said method comprising the steps of:

a) providing a filling material comprising:

particles having a sphericity from 0.7 to 1.0, and a diameter from 0.1 mm to 2.0 mm, each of said particles comprising:

(i) a core having an outer surface, said core comprising a material selected from the group consisting of cellulose, starch, polyalcohol, and sugar, or any combinations thereof, (ii) a first coating comprising a binder and a nicotine source, said first coating being applied on at least part of the outer surface of said core, wherein said particles are provided in an amount within the range of from 50 wt % to 100 wt % based on the total weight of said filling material, and wherein the filling material is free from tobacco material or comprises a tobacco material within the range of from 0.05 wt % to 10 wt %, based on the total weight of the filling material, and b) enclosing said filling material in a saliva-permeable pouch of a packaging material.

* * * * *